United States Patent [19]

Troxler

[11] 4,261,620

[45] Apr. 14, 1981

[54] TAPERED LOCK PIN FOR A CUTTER TOOL BIT

[75] Inventor: Lester B. Troxler, Hazel Park, Mich.

[73] Assignee: Carmet Company, Pittsburgh, Pa.

[21] Appl. No.: 89,689

[22] Filed: Oct. 30, 1979

[51] Int. Cl.[3] ..... E21C 35/18

[52] U.S. Cl. ..... 299/91; 175/413

[58] Field of Search ..... 299/91–93; 175/410, 413; 403/331, 378, 379, 381

[56] References Cited

U.S. PATENT DOCUMENTS

| | | | |
|---|---|---|---|
| 735,667 | 8/1903 | Harvey | 403/331 |
| 1,143,275 | 6/1915 | Hughes | 175/373 X |
| 2,205,238 | 6/1940 | Burt | 175/410 X |
| 2,326,908 | 8/1943 | Williams | 175/330 |
| 3,143,177 | 8/1964 | Galorneau | 175/413 |
| 3,271,080 | 9/1966 | Gowanlock | 299/92 |
| 3,563,325 | 2/1971 | Miller | 175/410 |
| 3,820,849 | 6/1974 | Lundstrom | 299/93 |
| 4,057,294 | 11/1977 | Krekeler | 299/93 |

FOREIGN PATENT DOCUMENTS

| | | | |
|---|---|---|---|
| 24652 | of 1898 | United Kingdom | 175/410 |

OTHER PUBLICATIONS

"Fullfacer Tunnelling Machines", Atlas Copco, Jun. 1975, 15 pages.

*Primary Examiner*—Ernest R. Purser

*Attorney, Agent, or Firm*—Vincent G. Gioia; William J. O'Rourke, Jr.

[57] ABSTRACT

An assembly for a cutting tool is disclosed comprising an upper body portion with a slot therethrough, a cutter tool insert disposed within the slot and a tapered pin disposed within a tapered aperture in the cutting tool in non-yielding, frictional engagement with a bottom surface of the insert.

14 Claims, 6 Drawing Figures

FIG. 1
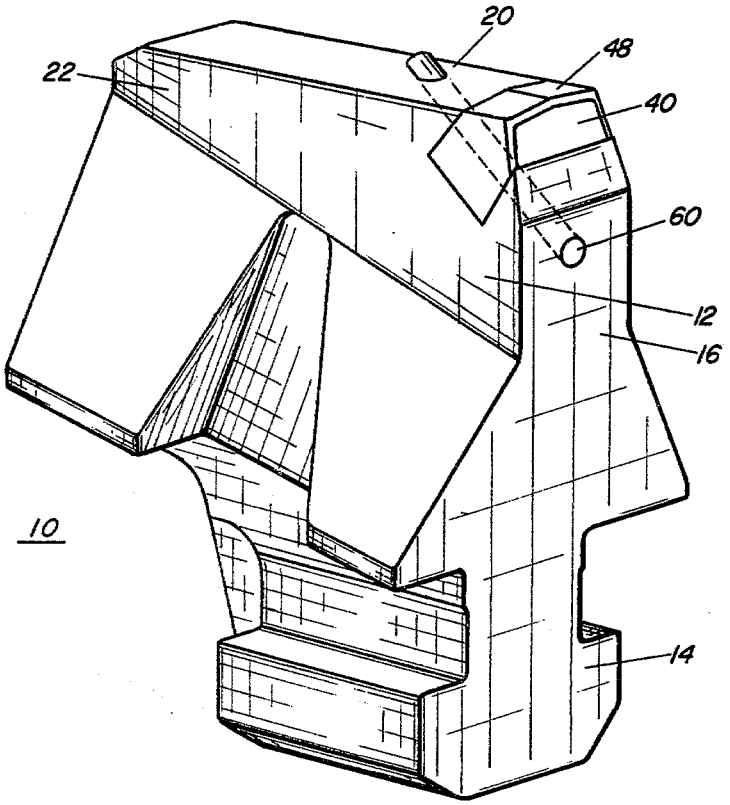
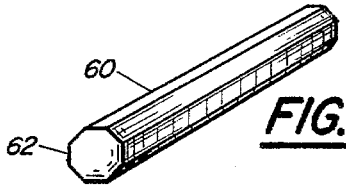
FIG. 4
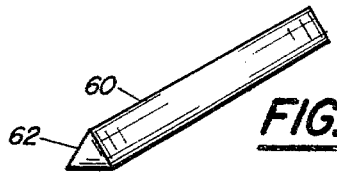
FIG. 5
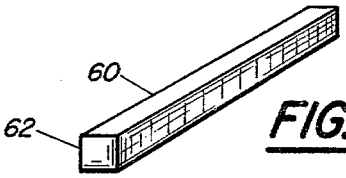
FIG. 6

TAPERED LOCK PIN FOR A CUTTER TOOL BIT

BRIEF SUMMARY OF THE INVENTION

The present invention relates to an improved bit assembly for a cutter tool and an improved method of retaining a cutter tool insert in a slot provided in a metallic cutter head or the like. More particularly, the present invention is directed to a rock drill bit assembly having a carbide insert held in a slot of a cutter head by a tapered pin disposed in non-yielding frictional engagement with a bottom surface of the carbide insert.

The prior art is replete with various examples of cutter tools. In certain applications, for example in mining, it has been found beneficial to incorporate cutting tips such as carbide inserts at the cutting point of the cutter tools. U.S. Pat. No. 3,820,849, for example, teaches the use of carbide tips in rock drilling machines. Such carbide tips are further discussed in *Fullfacer Tunnelling Machines,* Atlas Copco, June, 1975, page 10. This brochure explains that the conventional method of holding a carbide tip or insert in place on the body of a rock drill bit is by brazing.

The prior art teaches numerous alternative methods and devices for holding cutting tips in position on cutting tools. U.S. Pat. No. 1,143,275 teaches the use of a clamping device. U.S. Pat. No. 2,326,908 discloses screws or bolts which may be utilized to hold drill bit cutting segments in place. U.S. Pat. No. 3,143,177 shows a carbide cutter cemented to one face of a tool bit. U.S. Pat. No. 3,271,080 teaches the use of a spring loaded clamp to exert a holding force on a cutter bit, and the use of a pin to counteract such force when it is desired to exchange or index the cutter bit. U.S. Pat. No. 4,057,294 teaches the general use of a lug element laterally forced into proper position in a base member by a cylindrical pin.

The holding devices and apparatus of the prior art lack the simplicity required to effectuate rapid exchange of cutting inserts. Further, such prior art devices require auxiliary operations such as clamping, bolting, spring loading and threading which are not only time consuming but also require additional expense to construct. These and other prior art devices require the use of keys, wrenches, screwdrivers and other auxiliary tools which may be difficult to insert, apply and turn, especially in the operating environment in which cutter tools are utilized.

It is also readily apparent that improved designs and technological developments in the field of mining and rock cutting machinery are leading to the use of larger tools. Such trend toward bigger and sturdier tools is expected to continue in the future. For this reason, readily exchangeable and effective tip assemblies will have unique advantages for the larger tools of the future.

Accordingly, a new and improved tip for a cutter tool is desired which secures a cutter tool insert into position with a tapered pin of a relatively simple construction and permits rapid exchange of such inserts, and even permits on-site exchange of cutter tips.

The present invention may be summarized as providing a bit for a cutter tool comprising a metallic cutter body having an upper body portion with a slot therethrough, a cutter tool insert disposed within the slot and a tapered pin disposed within a tapered aperture in the cutter head in non-yielding frictional engagement with a bottom surface of the insert.

Among the advantages of the present invention is the provision of a new and improved bit assembly for a cutter tool which is characterized by simplicity of construction.

An objective of the present invention is to provide a new bit assembly for a cutter tool in which a cutter insert thereon is held in position without the use of bolts, threaded pins, clamping devices, springs, screws or the like, but rather is held in position by the non-yielding frictional engagement between a single tapered pin and the insert.

An advantage of the present invention is that a bit assembly is provided wherein a carbide insert may be easily and effectively installed and removed by driving and dislodging a tapered pin into and out of frictional engagement with a bottom surface of the insert. Such installation and removal may be readily accomplished with the use of a hammer, or similar device, to apply a force against the large diameter head of the pin for installation, and against the small diameter end of the pin for removal thereof.

Another advantage of the present invention is that in comparison to prior art devices wherein auxiliary locking mechanisms such as clamps, bolts and screws have to be cleaned in order to insert a wrench, screwdriver or the like thereon, in order to accomplish removal of the clamped or bolted article, the pin assembly of the present invention does not require any cleaning to accomplish the removal of the tip.

A further advantage of the present invention is the provision of a bit assembly for a cutter tool which enables the cutter inserts thereon to be exchanged at the working site.

These and other objectives and advantages may be more fully understood and appreciated with reference to the following detailed description and the drawings.

BRIEF DESCRIPTION OF THE DRAWINGS

FIG. 1 is a perspective view, partially in cross section, of a cutter tool bit of the present invention.

FIGS. 4 to 6 are perspective views of alternative tapered pins of the present invention.

DETAILED DESCRIPTION

Figure 2:
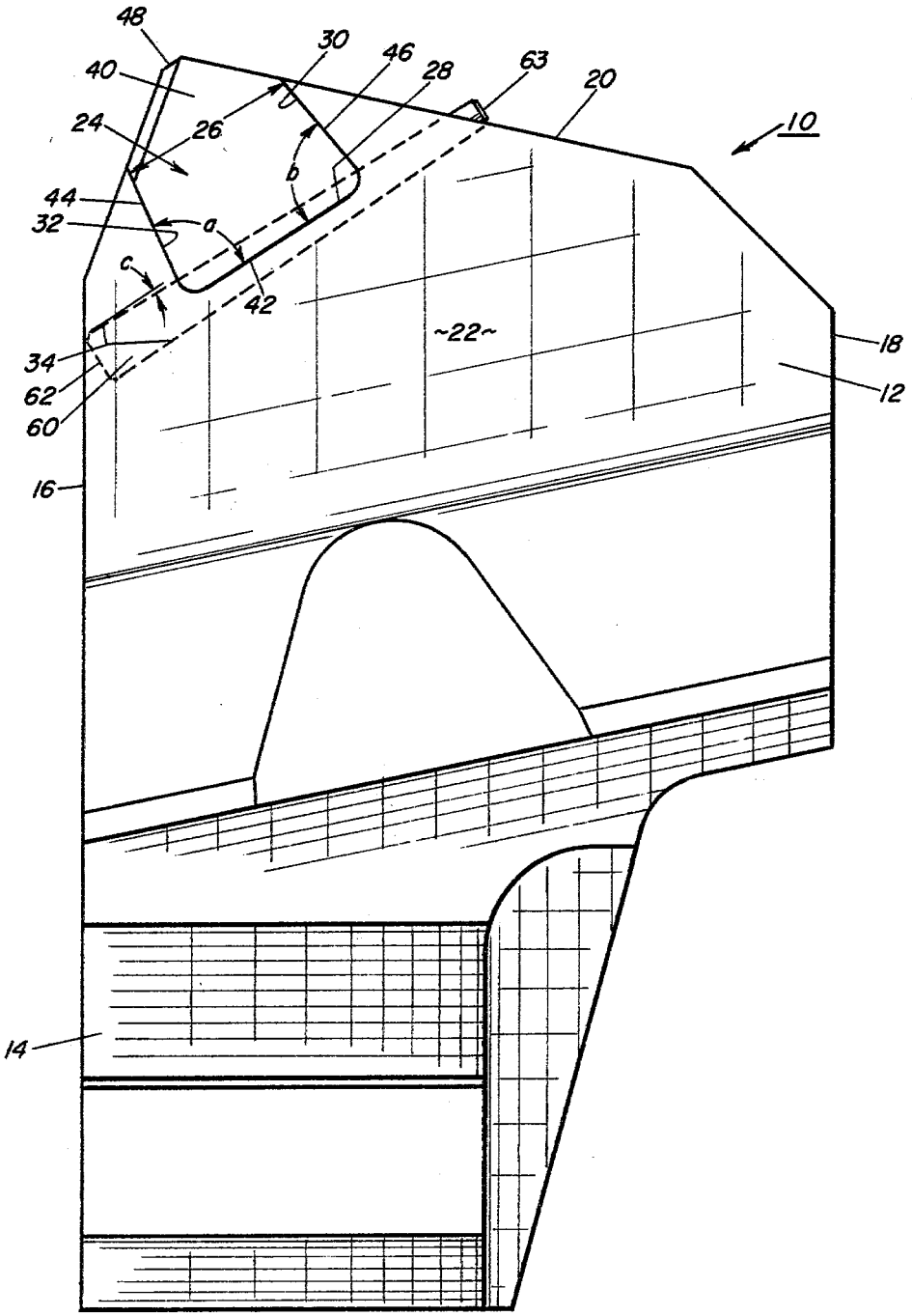
FIG. 2 is a side elevation view, partially in cross section, of the cutter tool bit shown in FIG. 1.
Figure 3:
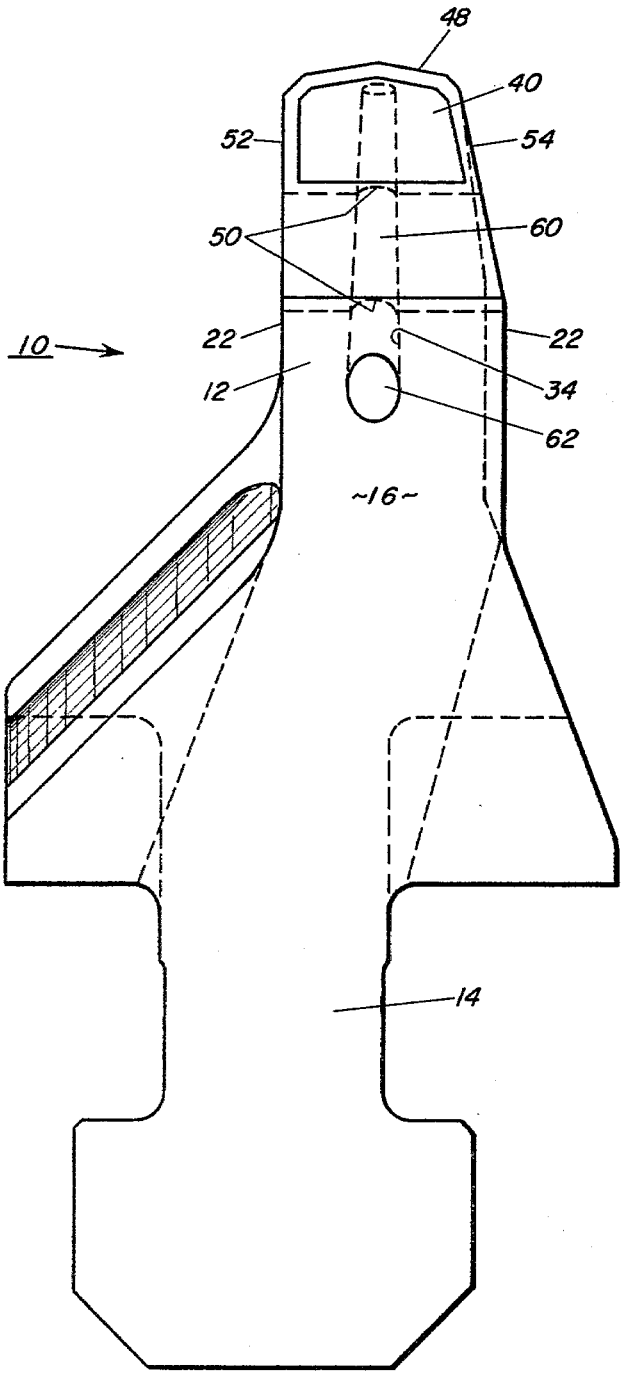
FIG. 3 is a front elevation view, partly in cross section, of the cutter tool bit shown in FIG. 1.

Referring particularly to the drawings, FIGS. 1, 2 and 3 illustrate a preferred cutter tool and bit assembly of the present invention. It should be understood and appreciated that a multitude of rock cutting and mining tools may employ the assembly of the present invention, and that the present invention is not intended to be limited in any was to the exemplary tool illustrated in the drawing. As shown in the drawings, the cutter tool includes a cutter head, generally designated by the reference numeral 10. The cutter head 10 is typically metallic and preferably is made of forged steel machined to the required dimension. The cutter head 10 is typically provided with an upper body portion 12 and an anchor portion 14 integral therewith. The anchor portion 14 is designed and constructed typically for mounting onto a large diameter cutter disc of a particular cutting machine. Various anchors, including but not limited to the illustrated T-anchor, are known in the art.

The upper body portion 12 of the exemplary cutter head 10 shown in the drawing extends upwardly with respect to the anchor portion 14 in a general rectangular configuration consisting of a front end wall 16, a rear wall 18, a top end wall 20 and lateral side walls 22.

At or near the junction of the top end wall 20 and the front end wall 16 is a slot 24. The slot 24 is open to at least one lateral side wall 22, and in a preferred construction extends from one lateral side wall 22 through the upper body portion 12 of the cutter head 10 to the other lateral side wall 22. The slot is defined by a base 28, an upper inside surface 30 and a lower inside surface 32. Preferably, the base 28 and the inside surfaces 30 and 32 of the slot are generally planar.

The slot 24 is tapered in the cutter tool bit assembly of the present invention. By tapered, it is meant that an opening 26 defining the lateral distance, between the top end wall 20 and the front end wall 16 at the slot 24, is less than the lateral distance of a base portion of the slot 24. In a preferred construction illustrated in the drawing the slot 24 is tapered by structuring the cutter tool bit assembly with an angle a or b of less than 90° formed between the base 28 and each of the inside surfaces 30 and 32. It has been found that providing such angle, a or b, of from 70° to less than 90° may be structurally adequate for rock drill bits and the like, and angles between 80° and 85° are more preferable. It should be understood by those skilled in the art that arcuate inside surfaces (not shown) may also be provided to form the tapered slot 24 of the present invention, provided such arcuate surfaces are characterized by an opening 26 having a smaller lateral dimension than a base dimension of the slot 24. For the purposes of such tapered slot dimensional relationship, the base of the slot should comprehend any portion below the opening 26 and should not necessarily be limited to the lowermost portion of the slot 24.

In a central portion of the cutter head 10 of the present invention is an aperture 34 extending from and open to an end wall such as the front end wall 16 and/or the top end wall 20. In preferred construction illustrated in the drawing, the aperture 34 is open to the front end wall 16 and tapers uniformly inwardly therefrom to the top end wall 20. It should be understood that such 20 structures could be revised such that the aperture tapered inwardly from the top end wall 20 toward the front end wall 16. The angle of taper c for the aperture 34 is less than 5°, and preferably is from 1° to 3°. The longitudinal axis of the tapered aperture should be substantially parallel to the planar base 28 of the slot 24. Preferably, the longitudinal axis of the tapered aperture 34 and the planar base 28 of the slot 24 are within 15 minutes of parallelism.

The aperture 34 tapering inwardly through a central portion of the upper body 12 of the cutter tool bit assembly of the present invention intersects at least a central portion of the planar base 28 of the slot 24. Thus, the aperture 34 and the slot 24 intersect at the base 28 of the slot 24 to provide a means for physical communication therebetween for purposes which will be explained in detail below.

A cutter tool insert 40 such as a carbide insert, is disposed within the slot 24 of the bit assembly of the present invention. The slot 24 and insert 40 are constructed with complimentary dimensions, as is typical in the art, to accommodate a tight fit. To place the insert 40 into the tapered slot 24 it is understandable that the insert 40 must be laterally slid into place such that a bottom surface 42 of the insert 40 is disposed against the base 28 of the slot 24, a first wall 44 is disposed against the upper inside surface 30 of the slot 24, and a second wall 46 is disposed against the lower inside surface 32 of the slot 24. In a preferred embodiment, the insert 40 and slot 28 surfaces discussed above are generally planar. As is typical in the art of cutter tool inserts 40, the first and second wall 44 and 46 of the insert 40 extend outwardly of the slot 24 through the slot opening 26 to converge and form a cutting edge 48. The side walls 52 and 54 of the insert 40 are preferably planar in construction and lie substantially flush, or approximately in the same general plane, as the side walls 22 of the upper body portion 12 of the cutter head 10.

A tapered pin 60, preferably cylindrical in construction, is disposed within the aperture 34 of the cutter head 10. Such pin 60 is provided with a taper angle of less than 5°. Understandably, the tapered pin 60 is preferably constructed with the taper and cross sectional dimensions substantially equal to that of the tapered aperture 34. Although such cylindrical construction is preferred, it will be understood that various polygonal cross sectional configurations provided with a longitudinal taper of less than 5° are also comprehended for both the aperture 34 and the pin 60 of the present invention. Alternative pin configurations are illustrated in FIGS. 4 to 6. It should be understood that the configuration of the aperture 34 and the pin 60 should be complimentary in each instance.

The pin 60, disposed within the aperture 34 may be driven into non-yielding frictional engagement with at least about 50% of the length of the exposed bottom surface 42 of the insert 40. Such engagement may be readily accomplished with an auxiliary tool such as a hammer. By striking the head 62 of the pin 60 in the direction of the taper, the pin 60 becomes lodged in the aperture 34 of the cutter tool bit assembly. Simultaneously, the pin 60 is driven into contact with the exposed bottom surface 42 of the insert 40 such that when the pin 60 is locked into position in the aperture 34, the insert 40 is forced upwardly and outwardly against the upper and lower inside surfaces 30 and 32 of the slot 24. Disposition of the pin 60 in such aperture has been found adequate to retain the insert 40 in its proper position without dislodging therefrom throughout the life of the insert 40. More particularly, the cutter tool bit assembly of the present invention provides a tapered pin locking mechanism which does not require brazing of the insert into position on the cutter head. Understandably, such locking mechanism requires significantly decreased installation and replacement time and expense.

By the assembly of the present invention, the tapered pin 60 is effectively seated in the aperture 34 and against the bottom surface 42 of the insert 40, or, in a preferred embodiment, against a groove 50 provided in the bottom surface 42 of the insert 40. Such pin, when driven into non-yielding frictional engagement with the insert 40, remains in position against all forces with the sole exception of force directed longitudinally against the pin axis from the small diameter end 63 toward the large diameter head 62 of the pin 60. During operation of the cutting tool, the forces exerted against the insert 40 may be immense. However, such forces are exerted directly against the surfaces of the insert 40, typically that surface which is substantially flush with the front end wall 16 of the cutting tool. Such forces are absorbed by the body of the cutting tool and do not adversely affect the placement and disposition of the tapered pin 60 locking the insert 40 in position.

Removal and replacement of the insert 40 in the cutter tool bit of the present invention is simpler than that taught by the prior art. Since the insert 40 does not have to be brazed into position, replacement is facilitated. Striking the tapered pin 60 at its small diameter, opposite the head 62 of the pin 60, would dislodge the pin from the aperture 34. In a referred embodiment the pin 60 is constructed with sufficient length that the small diameter end 63 protrudes slightly out of the top end wall 20 to facilitate removal of the pin 60. In an alternative embodiment, a knock-out tool may have to be utilized to reach the small diameter end of a pin 60 disposed inwardly of the tope end wall 20. By striking the small diameter end of the pin 60 with a hammer or an auxiliary tool, the pin 60 becomes dislodged and the insert 40 is released from its non-yielding frictional engagement therewith.

Therefore, it should be understood that the cutter tool bit assembly of the present invention facilitates replacement of carbide inserts 40 at the operating locations, such as in the mines or tunnels. Accordingly, the entire cutter tool bit of the present invention does not have to be discarded when it is necessary merely to replace an insert 40. In most applications, the cutter tool bit does not have to be removed from the cutting disc, nor does the cutting machine or tool have to be moved from the working site in order to replace the insert 40. Such simplicity in construction in combination with proven reliability of the locking mechanism, in the cutter tool bit assembly of the present invention provides a significant commercially acceptable advance in the rock cutting and mine tool related art.

In a preferred construction of the cutter tool bit assembly of the present invention, a portion of the bottom surface 42 of the insert 40 may be removed to form a groove 50 in the insert 40 which corresponds substantially with the configuration of the pin 60, and provides a contoured seat therefor. It will be understood that such groove 50 may provide increased protection against lateral movement of an insert 40 during service in certain cutting or mining applications. When such groove 50 is provided, an upper portion of the aperture 34 should lie generally in the same horizontal and vertical plane as such groove 50.

What is believed to be the best mode of this invention has been described above. It will be apparent to those skilled in the art that numerous variations of the illustrated details may be made without departing from this invention.

What is claimed is:

1. An assembly for an upper body portion of a cutting tool comprising:

a slot having a base, a first inside surface and a second inside surface, each extending from the base, and with the angles defined by the base and each of the inside surfaces each less than 90°, said slot extending from one sidewall of the upper body portion to the other sidewall, and said slot being open opposite the base, and a generally cylindrical aperture extending from and open to a wall of the upper body portion of said aperture tapering inwardly from said opening at an angle less than 5°, with the longitudinal axis of the tapered aperture substantially parallel to the base of the slot, and at least an upper portion of said aperture intersecting a central portion of the base of the slot, an insert disposed within the slot, said insert having a bottom surface disposed against the base of the slot, a first wall disposed against the first inside surface of the slot, and a second wall disposed against the second inside surface of the slot, with the first and second walls of the insert extending outwardly of the slot through the slot opening to converge and form a cutting edge, and a pin tapered less than about 5° with respect to the longitudinal axis of said pin, said taper substantially equal to the taper of the aperture, and said pin having cross sectional dimensions substantially equal to the cross sectional dimensions of the aperture, said pin disposed within said aperture in non-yielding frictional engagement along at least 50% of the length of the bottom surface of the insert which is in communication with the aperture at the intersection of the aperture and the base of the slot.

2. An assembly as set forth in claim 1 wherein the aperture and the pin are tapered at an angle of from 1° to 3°.

3. An assembly as set forth in claim 1 wherein the longitudinal axis of the tapered aperture and the planar base of the slot are within fifteen minutes of parallelism.

4. An assembly as set forth in claim 1 wherein the insert is carbide.

5. An assembly as set forth in claim 1 wherein sidewalls of the insert are substantially flush with lateral side walls of the upper portion of the cutting tool.

6. An assembly as set forth in claim 1 wherein the angles between the base and each of the inside surfaces of the slot are between 70° and less than 90°.

7. An assembly as set forth in claim 1 wherein the angles between base of each of the inside surfaces of the slot are between 80° and 85°.

8. An assembly as set forth in claim 1 wherein the insert is provided with a longitudinal groove in and along the bottom surface into which the pin is disposed in non-yielding frictional engagement.

9. An assembly as set forth in claim 8 wherein the longitudinal groove provided in and along the bottom surface of the insert lies substantially in the same vertical and horizontal planes as an upper portion of said aperture.

10. An assembly as set forth in claim 1 wherein the cutting tool has an anchor portion for mounting into a cutter disc.

11. An assembly as set forth in claim 10 wherein the anchor portion is integral with the upper body portion of the cutting tool.

12. An assembly as set forth in claim 1 wherein the tapered aperture extends from said opening completely through the upper body portion of the cutting tool.

13. An assembly as set forth in claim 12 wherein the small diameter end of the tapered pin projects outwardly of the upper body portion of the cutting tool.

14. A bit assembly for a cutter tool comprising:

(a) a metallic cutter head having an upper body portion comprising:

a front end wall, a rear wall, a top end wall, lateral side walls, a slot extending from one lateral side wall toward the other, which slot is open at the junction of the top end wall and the front end wall, said slot defined by a base, an upper inside surface, a lower inside surface, with the angles defined by the base and each of the inside surfaces each less than 90°, and a generally cylindrical aperture extending from and open to an end wall through a central portion of the upper body portion, said aperture tapering inwardly from said opening at an angle less than 5°, with the longitudinal axis of the tapered aperture substantially parallel to the base of the slot, and at least an upper portion of said aperture intersecting a central portion of the base of the slot, (b) a cutter tool insert disposed within the slot, said insert having a bottom surface disposed against the base of the slot, a first wall disposed against the upper inside surface of the slot, a second wall disposed against the lower inside surface of the slot, with the first and second walls of the insert extending outwardly of the slot through the slot opening to converge and form a cutting edge, and (c) a pin tapered less than about 5° with respect to its longitudinal axis, said taper substantially equal to the taper of the aperture, and said pin having cross sectional dimensions substantially equal to the cross sectional dimensions of the aperture, said pin disposed within said aperture in non-yielding frictional engagement along at least 50% of the length of the bottom surface of the cutter tool insert which is in communication with the aperture at the intersection of the aperture and the base of the slot.

* * * * *